US006601707B2

(12) United States Patent
DeSmedt

(10) Patent No.: US 6,601,707 B2
(45) Date of Patent: Aug. 5, 2003

(54) WICKETED AND WICKET-LESS BAGS AND METHOD OF FILLING THE BAGS

(75) Inventor: Eric DeSmedt, Opwijk (BE)

(73) Assignee: Hudson-Sharp Machine Co., Green Bay, WI (US)

( * ) Notice: Subject to any disclaimer, the term of this patent is extended or adjusted under 35 U.S.C. 154(b) by 0 days.

(21) Appl. No.: 09/785,795

(22) Filed: Feb. 16, 2001

(65) Prior Publication Data

US 2002/0112452 A1 Aug. 22, 2002

(51) Int. Cl.[7] ..... B65D 33/14
(52) U.S. Cl. ..... 206/554; 383/9
(58) Field of Search ..... 206/554; 383/9; 53/459, 570

(56) References Cited

U.S. PATENT DOCUMENTS

| | | | | |
|---|---|---|---|---|
| 4,342,564 A | | 8/1982 | Lehmacher | |
| 4,451,249 A | | 5/1984 | deBin | |
| 4,458,466 A | * | 7/1984 | Carbone et al. | 206/216 |
| 4,699,607 A | | 10/1987 | Lambrecht | |
| 4,903,839 A | | 2/1990 | Mattiebe et al. | |
| 5,030,191 A | | 7/1991 | Reifenhauser | |
| 5,495,946 A | | 3/1996 | Pickering et al. | |
| 5,590,784 A | * | 1/1997 | Daniels | 206/554 |
| 6,068,128 A | * | 5/2000 | Gardner | 206/554 |

FOREIGN PATENT DOCUMENTS

| | | |
|---|---|---|
| AU | 200022280 A1 | 9/2000 |
| DE | 199 17 284 A1 | 10/2000 |
| EP | 1 036 741 A2 | 9/2000 |
| WO | WO 99/48677 | 9/1999 |
| WO | WO 00/12300 | 3/2000 |

* cited by examiner

*Primary Examiner*—David T. Fidei
(74) *Attorney, Agent, or Firm*—Wood, Phillips, Katz, Clark & Mortimer

(57) ABSTRACT

A block of bags for a product filling process includes a plurality of bags stacked in overlying relationship. Each bag of the block has a top edge, a bag mouth and opposite first and second side edges. First and second edge lines of perforations extend from edge points on respective opposite lateral edges of the bag. The edge points are spaced closely to the bag mouth of the bag. A central line of perforations extends between inner ends of the first and second edge lines of perforations. The central line of perforations is offset from the edge points, away from the bag mouth. A tear-off region is defined between the central line of perforations and the top edge. During automatic filling of the bad, the edge lines of perforations are torn to form an open bag mouth, and the central line of perforations is torn after filling to separate the bag from the block. The bag can alternatively also include first and second substantially longitudinal lines of perforations extending from the central line of perforations upwardly to the top edge of the bag, extending substantially from opposite ends of the central line of perforations, forming corner tear-off regions. The corner tear off regions can be removed before the filling operation. The invention also provides a bag filling platform which holds bag lip portions at a depressed elevation so that lip portions that remain on the platform after bags are separated do not interfere with the filling of subsequent bags.

13 Claims, 8 Drawing Sheets

WICKETED AND WICKET-LESS BAGS AND METHOD OF FILLING THE BAGS

TECHNICAL FIELD OF INVENTION

The invention relates to thermoplastic bags which are stacked and blocked or unitized to be configured as a bag block. Furthermore, the invention relates to a method of successively filling the bags and separating the filled bags from the bag block.

BACKGROUND OF THE INVENTION

The prior art related to the subject matter of the present invention includes U.S. Pat. Nos. 4,451,249; 4,342,564; and 4,699,607; PCT publication WO 99/48677; and European Patent EP 1 036 741, all herein incorporated by reference. Pending U.S. Ser. No. 09/517,968, filed Mar. 3, 2000, is also herein incorporated by reference.

Bag blocks are used in food packaging assembly lines for bagging successively delivered products such as bread loaves. In the manufacture of bag blocks, one approach is described in U.S. Pat. No. 4,699,607 which involves producing two bags from each web segment or sheet wherein each segment is provided with a line of perforations defining a generally circular enclosed area located equidistant from the opposed edges of the sheet. A stack of such sheets is carried by a support, supporting a central medial band of the sheets. The sheets are unitized or blocked by a heated member projecting through the sheets in the perforated circular area of the sheets. To produce individual bag blocks, the sheet stack is cut along a line through the central medial band of the sheets.

For a wicketed bag stack, holes can be prepunched into the sheet within or outside of the circular perforated area, before the sheets are stacked, and posts are provided on the support for receiving the succession of sheets impaled thereon via the prepunched holes. The subsequently blocked stack of wicketed bags is moved to a filling station wherein bags can be dispensed from the bag block by tearing individual bags from the bag block.

Another method of forming a bag block follows the following steps:

- unwinding a layer of flat web of film from the unwind stand;
- folding the web of film over a folding board;
- applying a gusset in the web of film;
- entering the web of film into the bag forming machine via the infeed section;
- passing the intermittant moving part of the bag forming machine whereby a number of operations are done to the web, including the application of a perforation pattern;
- forming the bags by means of a sideweld or mixed weld sealing head;
- picking up and stacking bags on an index conveyor or an automated wicket handling system; and
- unitizing the stack of bags.

The unwind step can be accomplished by a standard Hudson-Sharp Machine Co. model SDU 1600 unwind stand. It is an electrical surface-driven and braked unwind with a compensator for perfect web tension control. A web guiding system ensures a centered web exiting the unwind stand.

The pre-centered web is pulled over the folding board by the infeed section of the bag machine, thereby forming a J-folded web whereby the lip is typically 35 to 45 mm wide. The folding board is a standard Hudson-Sharp Machine Co. 1500 mm folding board accessory. Optionally a bottom gusset is formed in the J-shaped web. The gusset former is a standard Hudson-Sharp Machine Co. 750 mm gusset former accessory.

The infeed section is the first section of the Hudson-Sharp Machine Co. model 4750W basic wicket machine. It pulls the J-folded web into the bag machine from the gusset former, folding board and unwind by means of a set of nip rolls typically driven by an AC motor. This AC motor is controlled by a frequency controller which obtains a speed reference from the main machine controller and the infeed dancer which is part of the infeed section and located just stream downwards of the nip rolls.

As a standard feature on the Hudson-Sharp Machine Co. model 4750W basic wicket machine, the intermittent moving part of the machine consists of two sets of servo driven nip rolls. In between the two pairs of nip rolls several attachments will modify the web of film such as by punching wicket holes for stacking and/or will detect the photo-eye mark for print registration. The formation of the bag is done in the sealing section of a standard Hudson-Sharp Machine Co. model 4750W. Typically the seals are side seals but mixed weld seals are also possible.

The picking up and stacking of the bags is done in the pick-up and conveyor section of a standard Hudson-Sharp Machine Co. model 4750W. Wicketed bags have wicket holes. Wicket holes have heretofore been circular, triangular, star shaped, or diamond shaped. The bags are stacked on wicket pins going through the wicket holes during stacking. Although this stacking method produces the most ordered stacking quality, it isn't a necessity. The bags can be made without any kind of stacking holes and be stacked on needles. The unitizing of the stack can be done with a standard Hudson-Sharp Machine Co. pin blocker. Accordingly, heated pins can be driven through the stack of bags. The unitizing is done in the lip area above a region of perforations. The subsequently blocked stack of wicketed bags is moved to a filling station wherein bags can be dispensed from the bag block by tearing individual bags from the bag block. During the filling operation perforations are broken to create an opening of each bag large enough to receive the product being packaged.

A method of filling and separating successive bags is described by the following steps:

- putting a stack in a stack recipient box and indexing the box to the bag filling area;
- opening the bag with an air nozzle or suction device;
- inserting the bag opening device or "spoons;" inserting the product into the bag;
- pulling the bag off the stack together with the product; and
- closing the bag and putting the bag on an offload conveyor.

The Ibonhart model IB 360 filler feeds each stack of bags into the filling area by means of a "recipient box." In a preparation station, an operator puts a stack of bags into a recipient box. When the recipient box in the filling area is empty, it is transferred away from the filling area and a prefilled new recipient box is placed into the filling position. In this process the stacks are presented substantially horizontally in the recipient box. A slight downward angle in the gusset area (i.e., bottom area of the bags when oriented upright) can be applied to lower the gusset area.

Once the filling starts or restarts, bags are removed from the recipient box in the filling station. An air blast, aimed towards the opening of the top bag initially opens the top bag. Once the bag is opened, a set of spoons is inserted into the bag. The spoons engage the mouth of the bag and open it to a somewhat rectangular shape which corresponds to the shape of the product to be packaged. At this moment the bag is held by the spoons but is still connected to the rest of the stack by means of the wicket wire via the wicket holes. By means of a pusher the product is pushed into the bag. When the product hits the bottom of the bag, the still moving pusher will rip off the bag from the stack over the wicket wire. According to another known method, the spoons open the bag and then draw the bag in a reverse direction to the direction the spoons entered the bag, i.e., in a forward direction, to separate the bag from the block and at the same time to capture a stationary product within the moving bag. According to either method, the product together with the bag is then brought into another area of the filler where the bag is closed and transported for further handling.

As the stack is depleted, the recipient box is moved vertically upward to maintain an equal filling plane. The filled bag is pulled off the stack, over the wicket wires. Since the bag is completely removed after each fill, the top of the remaining stack has full clearance without leaving any scrap which could interfere with the filling process. However, the entire lip is removed with the bag which can constitute an undesirable extra flap connected to each bag.

Another method of filling a succession of bags is described in Australian published application AU 20002280 A1. According to this reference, a stack of bags is positioned on a support. The stack is held on holding rods and a flap region of the stack is clamped to the support. In this disclosure, the act of opening the bag breaks angularly oriented lines of perforations and substantially severs the top bag from corner portions of the bag flap entirely or except for short unperforated parts adjacent to the top edge of the bag. A product, such as a loaf of bread, is inserted into the open mouth of the bag and the bag with product inside is separated from the corner portions of the bag flap by breaking the short unperforated parts if they are present. A considerable amount of flap material is included with the separated bag. As the height of the bag decreases, the stacking table is moved up against the clamping plate.

The present inventor has recognized the desirability of providing bags to be dispensed from a block of bags, wherein the bags are unitized in a bag block, each bag having a lip, wherein individual bags can be removed from the block with a minimized portion of the lip connected to the separated bag. The present inventor has also recognized the desirability of providing a method of filling such bags, wherein the bags are filled and successively torn from the block, wherein the lip portions remaining on the block do not interfere with the filling of subsequent bags.

SUMMARY OF THE INVENTION

The present invention contemplates an improved design for wicketed and wicket-less blocked bag stacks or bag blocks wherein the bags are unitized within a lip or flap area thereof, and wherein a top bag body of the block is removed from the stack with a minimally-sized lip portion of web material adjoined thereto.

In a first aspect of the invention, two edge lines of perforations extend inwardly from edge points on respective side edges of the bag, for a short distance. A central line of perforations extends between the two edge lines of perforations, offset from the edge points toward a top edge of the bag. Preferably, the central line of perforations is less easily torn than the two edge lines of perforations. The edge lines of perforations can be perpendicular to the side edges and parallel to the central line of perforations, or can be oblique to the side edges and to the central line of perforations. The central and two edge lines of perforations can be joined together by oblique or perpendicular line segments or curve segments of perforations, preferably being perforations which are easily torn, similar in degree to the tear strength of the first and second edge lines of perforations.

A plurality of such bags are collected in a stack. A hot plate or pin is driven through corner lip areas defined by the adjacent side and top edges of each bag, and the two lines of perforations, and a hot plate or pin is driven through a central lip area defined between the top edge and the central line of perforations, to unitize or block the stack of bags.

This embodiment can be incorporated into a wicket-less or wicketed bag. In the case of a wicketed bag, two wicket holes can be provided between the top edge and the central line of perforations.

During a filling operation, the top bag is opened from a flat to a rectangular or pillow configuration with a substantially rectangular open mouth, adjacent to the lip. During the opening, the two edge lines of perforations, which are easily torn, separate or tear to accommodate the rectangular shape of the mouth. After the bag is filled, it is forcibly torn along the central line of perforations to separate the bag body from the bag block. The bag once separated, includes only a short lip portion, taken in a longitudinal direction of the bag. The bag block retains the remaining lip portion from the separated bag. As more bags are removed, the remaining lip portions of the previously separated bags can become an obstacle to filling subsequent bags, unless inventive apparatus are utilized.

In this regard, according to a second aspect of the invention, the bag block is held on a support platform during filling, wherein the support platform includes an obliquely oriented lip support with an associated clamp which holds the remaining lip portions to the lip support. The remaining lip portions are held below the elevation of the bottom bag, such that remaining lip portions will not interfere with filling the entire stack of bags, beneath the original top bag.

In another aspect of the invention, two substantially rectangular corner tear-off regions are provided at the upper corners of a bag. The corner tear-off regions are each substantially defined by one lateral edge of the bag, the top edge of the bag, one edge line of perforations as described in the first embodiment, and one of two short lines of perforations extending substantially from the one edge line of perforations to the top edge of the bag.

Wicket holes can be provided within a central region of the lip. A hot plate or pin is passed through the stack of bags, within each of the corner tear-off regions, and through the central region of the lip, to unitize the stack of bags as a bag block.

The corner tear-off regions are removed before the block reaches a filling station. Preferably, plural stacked corner regions are removed together from a formed bag stack or bag block by clamping the corner regions and clamping the remaining bag stack or block separately and differentially moving the two clamping mechanisms to separate the corner regions from the stack or block. Alternately, the corner regions are removed from each bag during bag formation on the bag forming machine. The corner tear-off regions are clamped, and the remaining bag is separately clamped. Using differential movement between the clamps, the corner regions are removed from the bag by tearing along the perforations. It is also possible that the bag block with corner regions attached thereto is shipped to the filling station, such as a bakery, where the corner regions are removed prior to or during filling. The corner tear-off regions are removed before the filling operation to facilitate the initial opening of the bag mouth from a flat condition to a rectangular shape.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
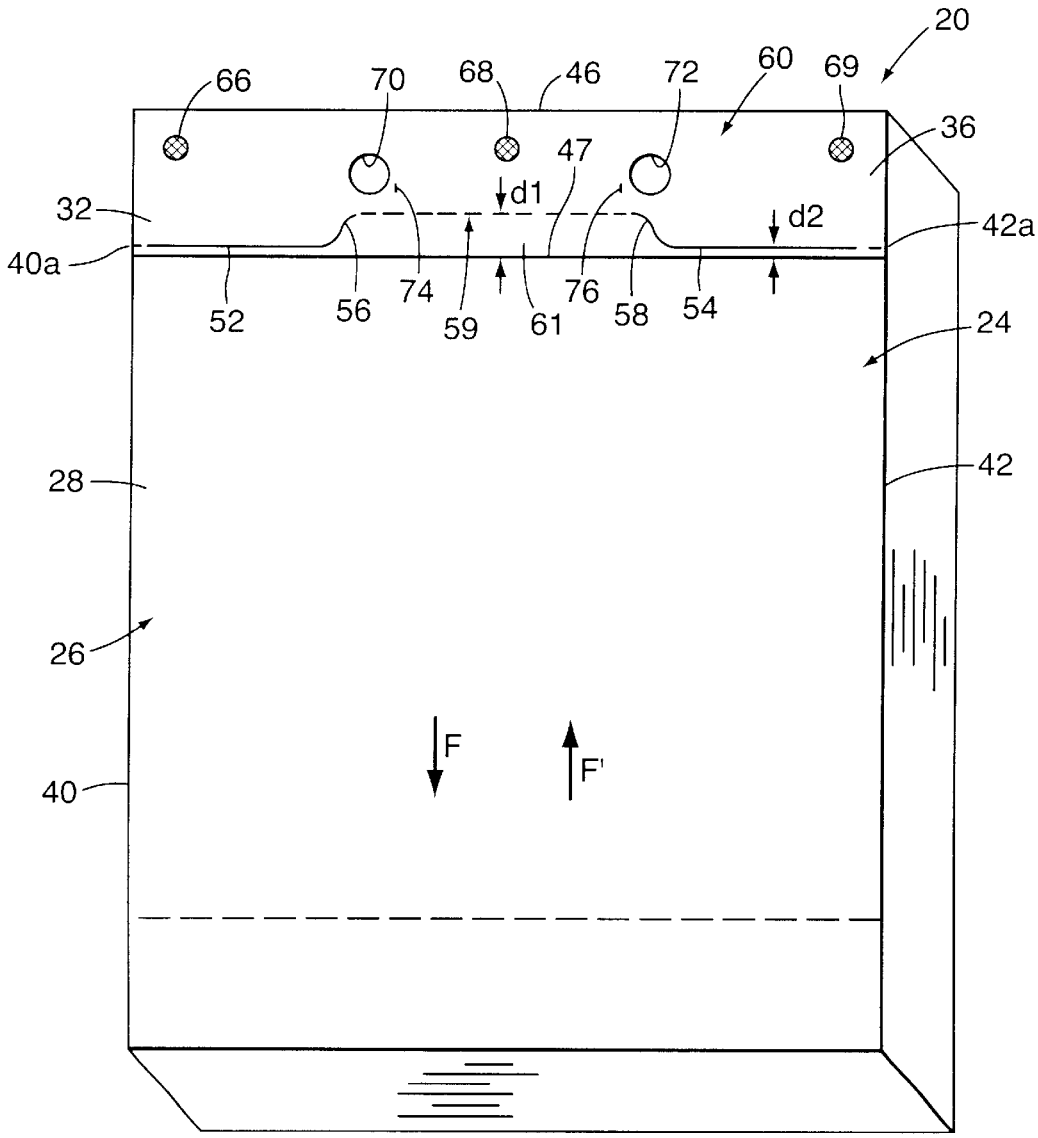
FIG. 1 is a perspective view of a first embodiment stack of bags in accordance with the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Exemplary apparatus for manufacturing, stacking and blocking bag stacks are described in the aforementioned U.S. Pat. No. 4,699,607 and U.S. Ser. No. 09/517,968, filed Mar. 3, 2000, both herein incorporated by reference.

FIG. 1 illustrates a block 20 of bags 24 according to a first embodiment of the invention. Each bag 24 includes a tubular body 26 having a front wall 28 and a back wall 32 which extends upwardly of the front wall, forming a back wall top flap or lip 36. The bag body has first and second sealed or fold-formed side edges 40, 42, a top edge 46, and a bag mouth 47.

Extending perpendicularly and inwardly from a first edge point 40*a* on the first side edge 40, is a first edge line of perforations 52. Extending perpendicularly and inwardly from a second edge point 42*a* on the second side edge 42, is a second edge line of perforations 54. The first and second edge points 40*a*, 42*a* can be located on or very close to the bag mouth 47. A first angular segment of perforations 56 extends from an end of the first edge line of perforations 52, obliquely toward the top edge 46. A second angular segment of perforations 58 extends from an end of the second edge line of perforations 54, obliquely toward the top edge 46. A central line of perforations 59 extends between ends of the segments of perforations 56, 58. The central line of perforations 59 can be located at a distance d1 from the mouth 47 that is greater than a distance d2 between either the first and second edge points 40*a*, 42*a* and the mouth 47. Advantageously, this distance d1 is about 10 to 15 mm.

A lip tear-off region, or distal lip portion, or remaining lip portion 60 is defined by the lines of perforations 52, 54, 56, 58, 59, the side edges 40, 42, and the top edge 46 of the bag body 26. A bag lip portion 61 is defined by the lines of perforations 52, 54, 56, 58, 59, the side edges 40, 42, and the bag mouth 47. A unitizing area 66 is formed through the stack 20 within the lip tear-off region 60, between the top edge 46 and the line 52, substantially perpendicularly to the plane of the back wall 32. A second unitizing area 68 is formed within the lip tear-off region 60 between the edge 46 and the line 59, and through the stack 20, substantially perpendicularly to the plane of the back wall 32. A third unitizing area 69 is formed within the lip tear-off region 60 between the edge 46 and the line 54. The first, second and third unitizing areas 66, 68, 69 are formed by penetrating the stack 20 with one or more hot plates or pins, which form holes through the stack and melt-fuses together the bags 24 within the areas 66, 68, 69. It is possible that the holes formed within the areas 66, 68, 69 can be made large enough to subsequently receive rods for guiding or supporting the stack.

Wicketing holes 70, 72 and/or pin holes 74, 76 can be located within the lip region 60 which are utilized as described in U.S. Pat. No. 4,699,607 or U.S. Ser. 09/517,968. The wicketing holes 70, 72 and/or the pin holes 74, 76 act in conjunction with posts and/or sharpened pins to align bags during stack formation. Subsequently, the wicketing holes 70, 72, or the holes formed within the areas 66, 68, 69, can receive wires, posts or rods to guide and/or support the stack and allow individual bags to be torn from the stack.

It is advantageous that the line of perforations 59 is perpendicular to the tear-off or pull direction F, or an alternate pull direction F', when a user or automated equipment is separating a bag 24 from the stack 20. In this way, maximum tensile stress is exerted on residual web material along the perforated line 59.

Although the edge lines of perforations 52, 54 are shown to be perpendicular to the side edges 40, 42, and parallel to the central line of perforations 59, it is also encompassed by the invention that the edge lines of perforations 52, 54 are oblique to the side edges 40, 42, extending at an acute angle to the side edges from the points 40*a*, 42*a* toward the central line of perforations 59.

Figure 2:
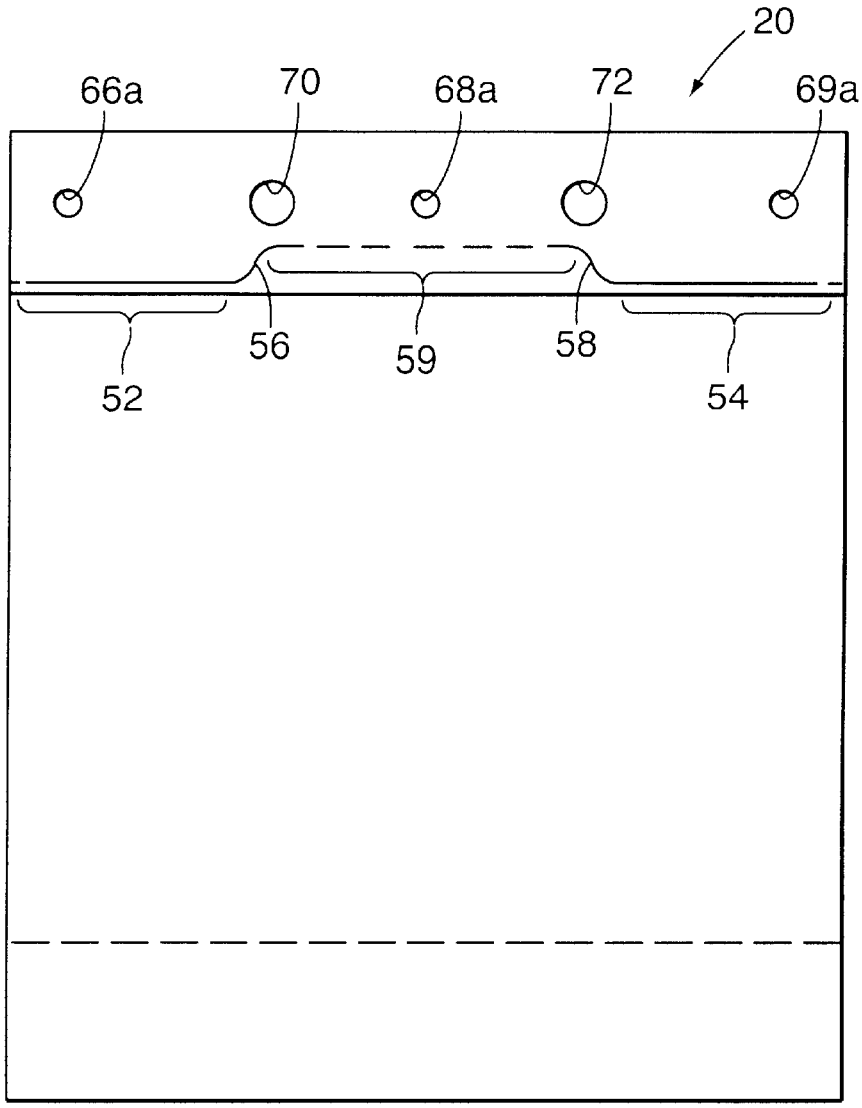
FIG. 2 is a plan view of the first embodiment stack of bags of FIG. 1, shown in a prior stage of manufacture.

FIG. 2 illustrates the first embodiment of the invention in a prior stage of assembly. In this stage, the step of forming the unitizing areas 66, 68, 69 is optionally preceded by pre-drilling or otherwise forming holes 66*a*, 68*a*, 69*a*. This assists the hot plates or pins rods in penetrating and unitizing the stack through the holes 66*a*, 68*a*, 69*a*.

Figure 3A:
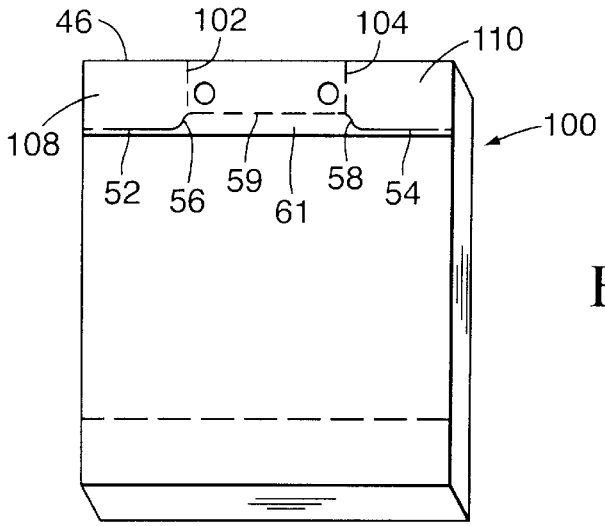
FIG. 3A is a plan view of the second embodiment stack of bags in accordance with the present invention, in a first stage of manufacture.
Figure 3B:
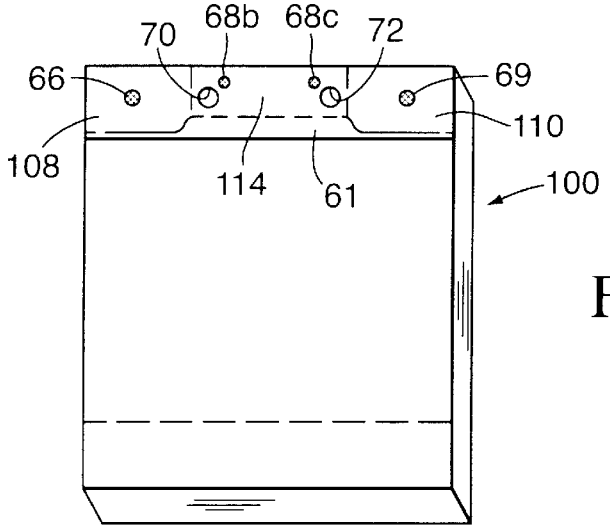
FIG. 3B is a plan view of the second embodiment stack of bags in a second stage of manufacture.
Figure 3C:
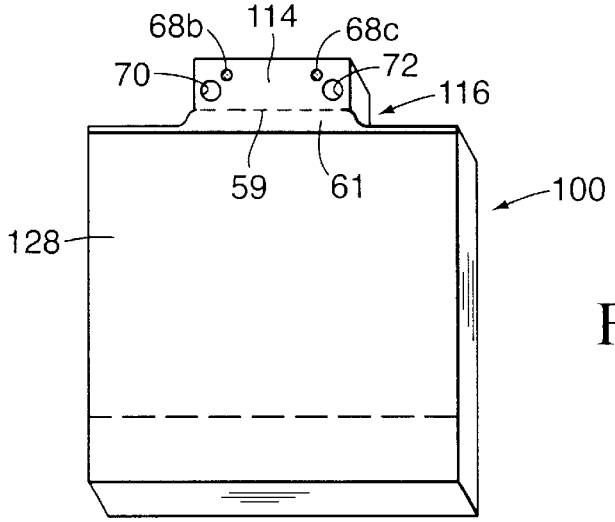
FIG. 3C is a plan view of the second embodiment stack of bags in a third stage of manufacture.

FIGS. 3A–3C show an alternate embodiment bag block 100 in three stages of manufacture. Those features of the alternate bag block 100 which are identical to features in the previously described bag block 20 are identified with like reference numerals. The alternate bag block 100 includes substantially longitudinal lines of perforations 102, 104 which substantially extend from ends of the central line of perforations 59 to the top edge 46 of the bag block. The substantially longitudinal lines of perforations 102, 104, the angular segments of perforations 56, 58 and the edge lines of perforations 52, 54 form corner tear-off regions 108, 110 respectively.

Although the substantially longitudinal lines of perforations 102, 104 are shown to be perpendicular to the central line of perforations 59, it is also encompassed by the invention that the substantially longitudinal lines of perforations can be obliquely angled to the longitudinal direction such as being angled toward each other toward the top edge of the bag.

FIG. 3B illustrates the bag block 100 of FIG. 3A, but further including central unitizing regions 68*b*, 68*c* located within a central lip region 114 that is located between the tear-off corner regions 108, 110.

FIG. 3C illustrates the bag block 100 of FIG. 3B with the corner regions 108, 110 removed. The central lip region 114 is unitized throughout the stack by the regions 68*b*, 68*c*. The central lip region 114 can be held by wickets through the wicket holes 70, 72 or by other means as described below during dispensing of the bags at a filling station. As each bag is filled it is then removed by separation along the central line of perforations 59. Because the corner regions are removed, each successive top bag can be opened into a rectangular configuration easily.

Figure 4A:
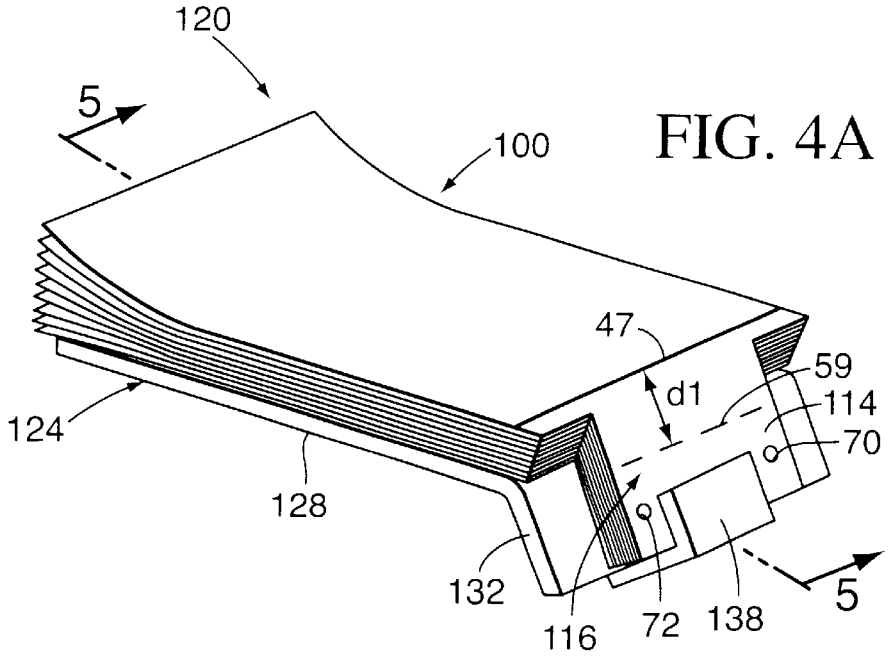
FIG. 4A is a perspective view of a bag filling apparatus of the invention in a first stage of operation.

FIG. 4A illustrates the block 100 in, a filling station 120 supported on a support table 124. The support table 124 includes a substantially horizontal support plate 128 and an oblique, lip supporting plate 132. The central lip region 114 is supported on the plate 132 and clamped thereon by a clamp member 138. Alternatively, or additionally, wicket pins 139 supported by a bracket 140 (shown in FIG. 5) can penetrate through a back side of the plate 132 through the wicket holes 70, 72 to hold the lip region 114 on the plate 132.

Figure 4B:
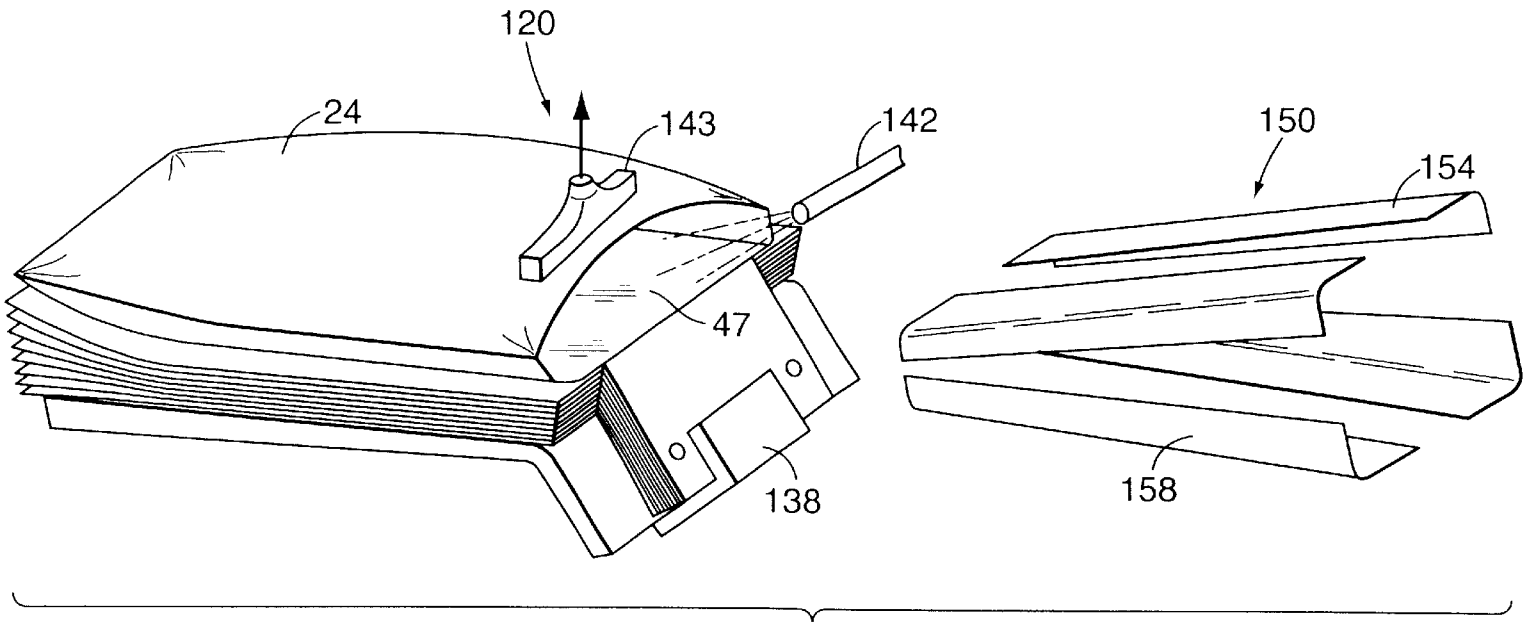
FIG. 4B is a perspective view of the bag filling, apparatus of FIG. 4A in a second stage of operation.

FIG. 4B illustrates an air delivery device 142 blowing an air stream onto the top bag 24 particularly into the mouth 47 of the top bag 24. The air stream tends to open the bag from a flat condition to a rectangular or pillow shaped configuration. Alternately, or additionally, a suction device or suction cup 143 can be used to open the mouth 47. The suction device 143 can be configured to engage the bag wall at the mouth and then to move upwardly to open the mouth. An opening device 150 which includes an upper opening mechanism or spoons 154 and a lower opening mechanism or spoons 158 is configured to be inserted into the open mouth 47 of the top bag 24.

Figure 4C:
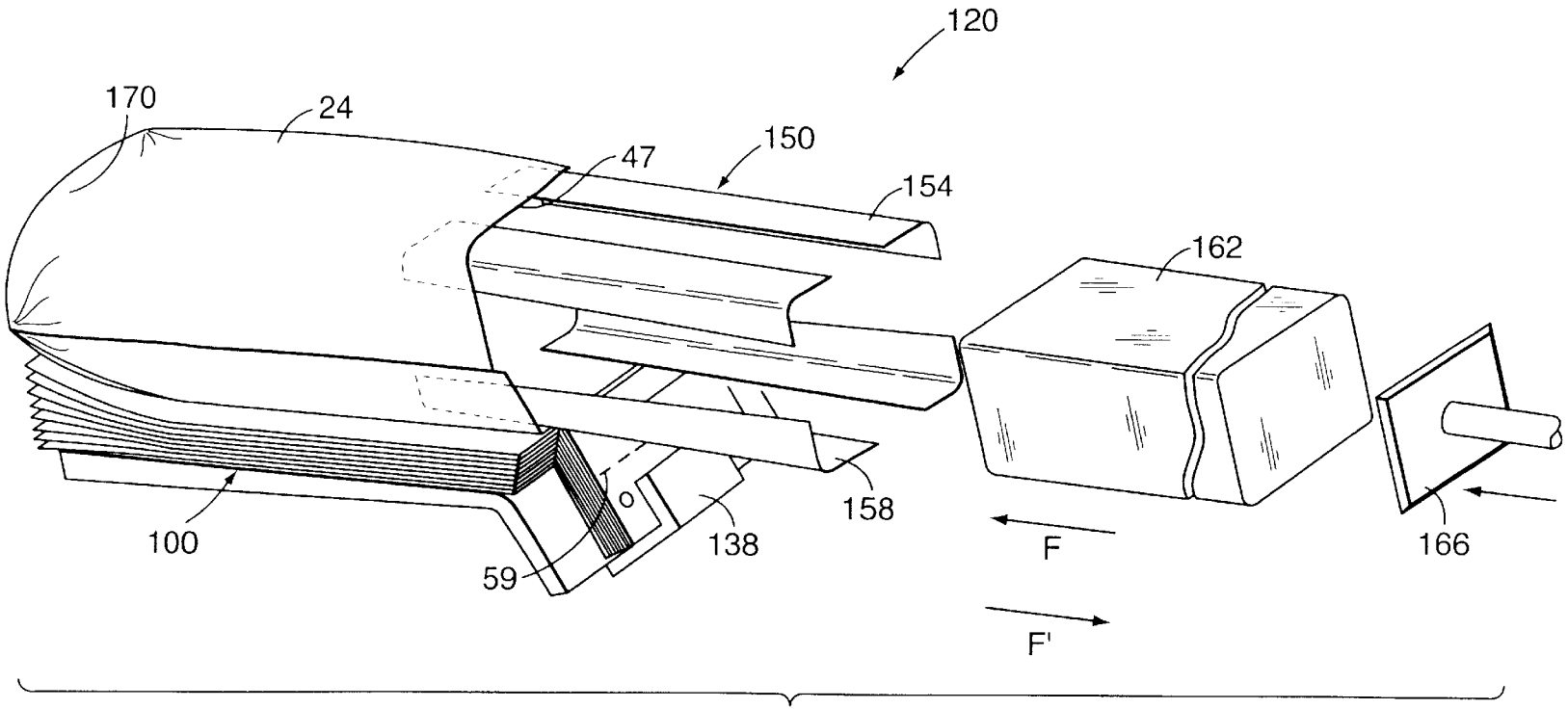
FIG. 4C is perspective view of the bag filling apparatus of FIG. 4A in a third stage of operation.

FIG. 4C shows the opening device 150 inserted into the bag mouth 47 and then having the spoons 154, 158 pivoted to expand the device 150 to hold the bag 24 in the open configuration. A product 162 is inserted into the bag 24 through the opening device 150. The product 162 is inserted via a pusher 166 which pushes the product 162 through the bag and against an end wall 170 thereof with a force sufficient to tear the top bag 24 along the perforation line 59 to separate the top bag 24 from the block 100. This force is along the direction F.

Figure 5:
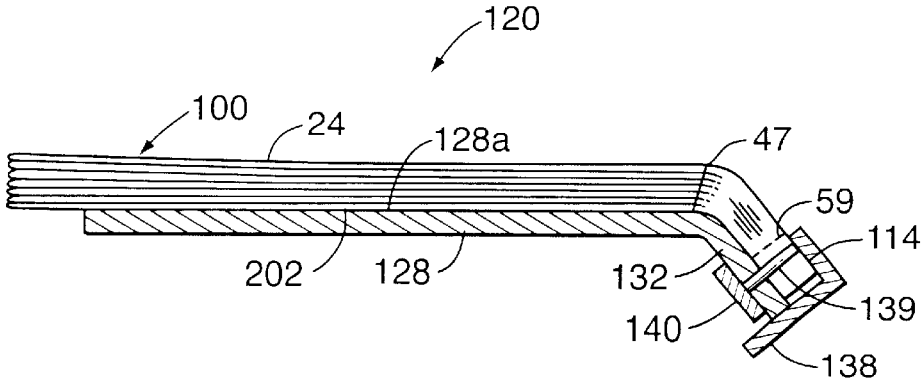
FIG. 5 is a sectional view taken generally along line 5—5 of FIG. 4A.

FIG. 5 illustrates the filling station 120 in section. This figure illustrates that the oblique plate 132 allows the perforation line 59 to be located generally at or below a top surface 128*a* of the support table 128. This allows the succession of bag opening mouths 47 to be located at a higher elevation than the remaining lip regions 114 such that the remaining lip regions 114 do not interfere with the filling of subsequent mouth of the bags down to a bottom bag 202. Although it is advantageous to have the bottom bag 202 located above the remaining lip region 114, it may also be acceptable for overall non-interference to have the remaining lip regions 114 held at an elevation only below some or most, but not all, of the bags in the block. For example, it may be because of the size of the product with respect to the size or shape of the bag mouth that it is only necessary that the remaining lip regions 114 on the plate 132 be below a bag mouth that is only half way down the original block of bags.

According to another known filling method, the spoons open the bag and then draw the bag in a reverse direction to the direction the spoons entered the bag, i.e., in a forward direction, along the line F', to separate the bag from the block and at the same time to capture a stationary product within the moving bag. The apparatus of FIGS. 4A–4C are equally applicable to this method, with the exception of the pusher.

Figure 6:
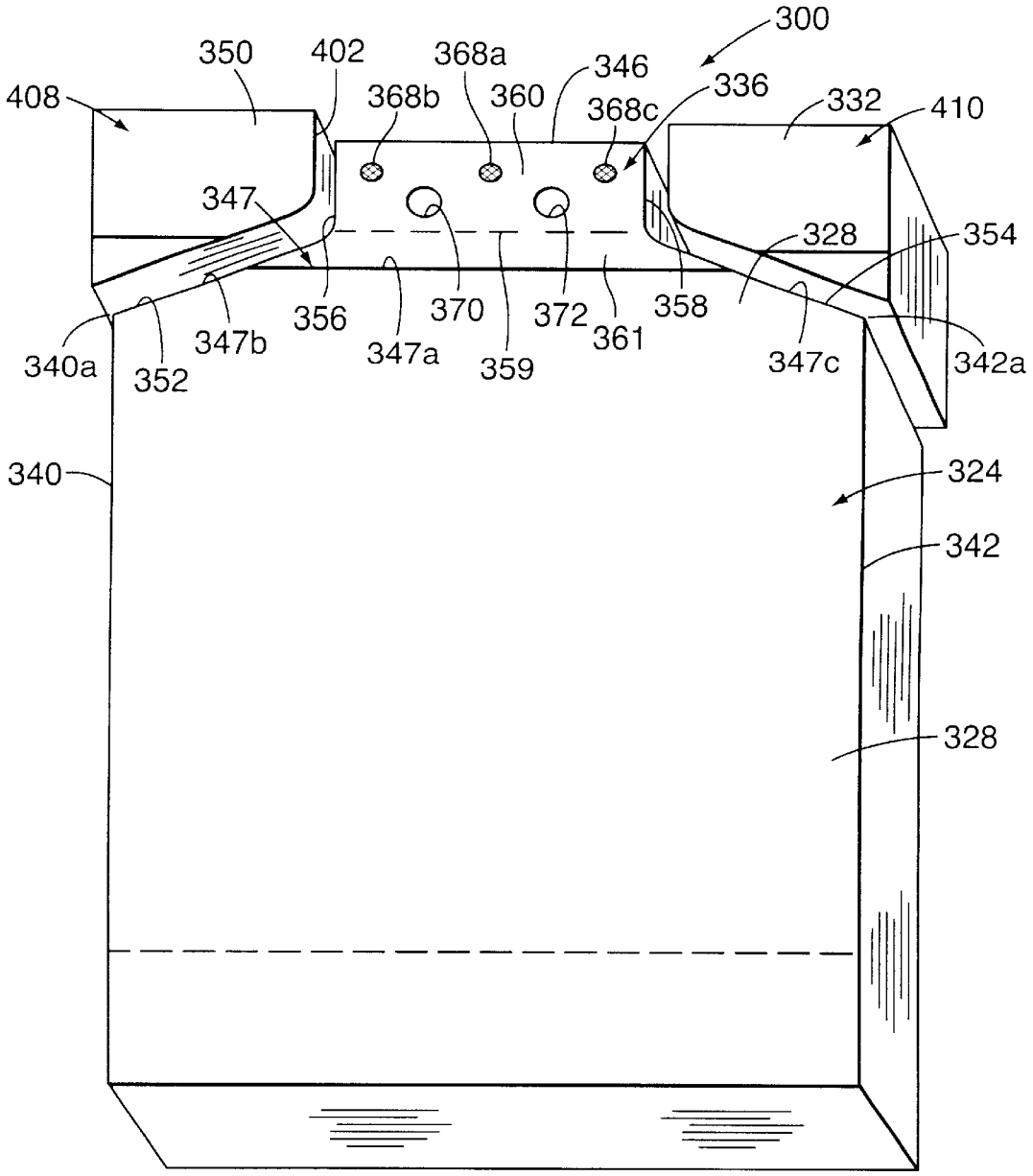
FIG. 6 is a perspective view of a further alternate embodiment bag block of the present invention.

FIG. 6 illustrates an alternate bag block 300. This bag block 300 includes alternate bags 324 having alternate tubular bag bodies 326. Each body 326 includes a front wall 328 and a back wall 332 which extends upwardly of the front wall, forming a back wall top flap or lip 336. The bag body has first and second sealed or fold-formed side edges 340, 342, a top edge 346, and a bag mouth 347. Similar to the bag block 100 described in FIGS. 3A–3C, corner portions 408, 410 are removed from the bag block 300, before the bag block is delivered to a filling station. For purpose of description of the perforations, the corner portions are shown with the bag block, slightly separated therefrom.

Extending obliquely and inwardly from a first edge point 340*a* on the first side edge 340, is a first edge line of perforations 352 (shown already broken from the corner portion 408). Extending obliquely and inwardly from a second edge point 342*a* on the second side edge 342, is a second edge line of perforations 354 (shown already broken from the corner portion 410). The first and second edge points 340*a*, 342*a* are located on or below the original bag mouth 347, i.e., the bag mouth 347 before the corner regions are removed. Before the corners 408, 410 are removed, the edge lines of perforations 352, 354 are formed through the front wall 328 and the back wall 332 of the body 326 at the edge points 340*a*, 342*a*. A first substantially longitudinal segment of perforations 356 (shown already broken from the corner portion 408) extends from an end of the first edge line of perforations 352, toward the top edge 346. A second substantially longitudinal segment of perforations 358 (shown already broken from the corner portion 410) extends from an end of the second edge line of perforations 354, toward the top edge 346.

The corner regions 408, 410 are removed by breaking the lines of perforations 352, 354, 356, 358. The finished bag mouth 347, once the corner regions 408, 410 are removed, thus includes a laterally arranged central region 347*a* and two oblique edge regions 347*b*, 347*c*.

A central line of perforations 359 extends between ends of the first and second lines of perforations 352, 354. A lip tear-off region, or distal lip portion, or remaining lip portion 360 is defined by the lines of perforations 352, 354, 356, 358, 359, and the top edge 346 of the bag body 326. A bag lip portion 361 is defined by the lines of perforations 352, 354, 359, and the central region 347*a* of the bag mouth 347.

Unitizing areas 368*a*, 368*b*, 368*c* are formed through the stack of bags 24 within the lip tear-off region 360. The unitizing areas 368*a*, 368*b*, 368*c* are formed by penetrating the stack of bas 324 with one or more hot plates or pins, which form holes through the stack and melt-fuses together the bags 324 within the areas 68*a*, 368*b*, 368*c* as described previously. Wicketing holes 370, 372, or other functional holes as previously described, can be located within the lip region 360.

During a filling operation, the central line of perforations 359 and the wicket holes 370, 372 perform the same function as that described in the prior embodiments.

Figure 7A:
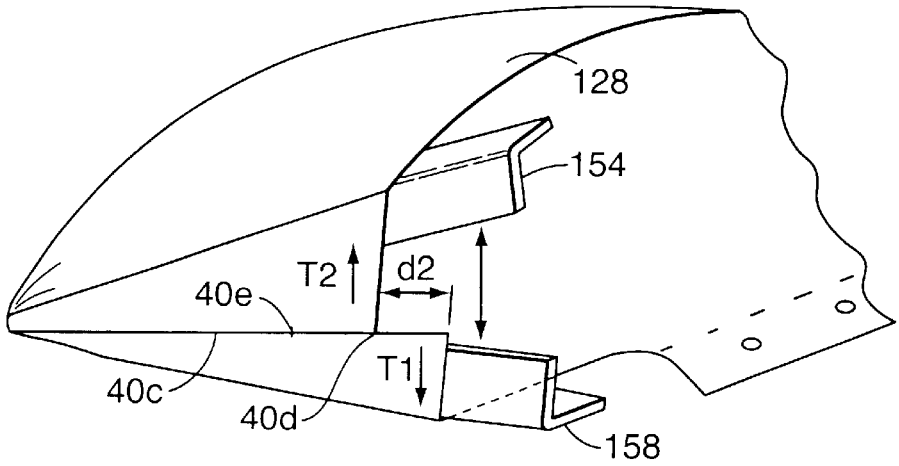
FIG. 7A is a diagrammatic perspective view of a bag being opened as shown in FIG. 4C.
Figure 7B:
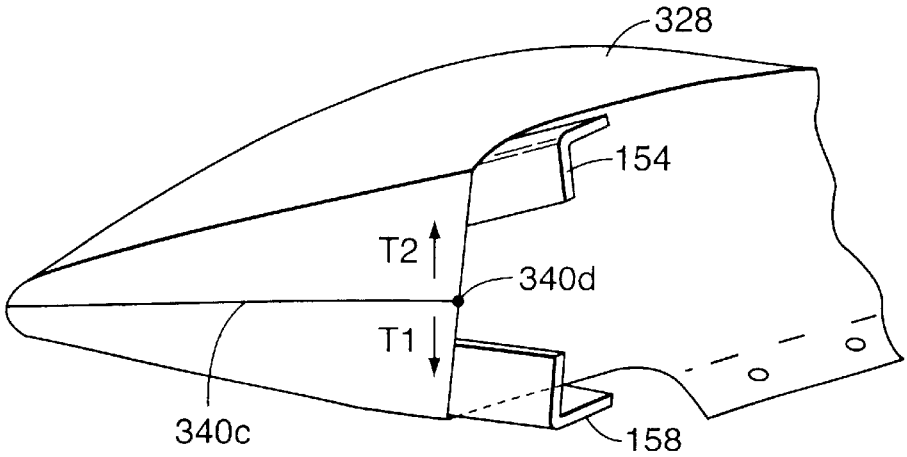
FIG. 7B is a diagrammatic perspective view of a bag being opened, comparable with FIG. 7A, except using a bag from the block shown in FIG. 6.

One advantage of the configuration of FIG. 6 is demonstrated in FIGS. 7A and 7B. FIG. 7A illustrates, in diagrammatic fashion, the opening of a bag body 128 configured in accordance with FIGS. 3A–3C. The spoons 154, 158 stretch open the bag in a vertical direction. This causes an offset loading due to the loads T1 and T2. The load T1 is offset from the load T2 due to the extending lip 61, extending by the distance d2. This offset loading, although small due to the small distance d2, can possibly cause an increased incidence of seal failure along side edge seals 40*c*, at the point 40*d*. Given greater distances d2 than that of the present invention, it has heretofore been known to include a side seal discontinuity or "seal saver" 40*e* in the side seal 40*c* to stop the propagation of a rip down the side seal during bag opening.

FIG. 7B illustrates that according to the embodiment of FIG. 6, there is no offset loading of T1 and T2 at the side seal 40*c* and no enhanced stress at the point 40*d* to cause propagation of a rip down the side seal. The need for a seal discontinuity 40*e* is obviated.

Although the alternate bag block 100 is shown in use with the filling station 120 in FIGS. 4A–5, the bag block 20 shown in FIGS. 1–2 and 6 can also be mounted on the filling station 120 shown in FIGS. 4A–5 as well. In that application, when the air source 142 opens the bag, the side edge perforations 52, 54 would be broken to allow for the bag to assume a pillow shape or rectangular configuration as shown in FIG. 4B. Additional needs, such as the suction device or suction cup 143 (shown in FIG. 4B) applied on the top layer of the bag and then moving vertically upward, for example, might be necessary to break the edge perforations.

In any of the embodiments of FIGS. 1–2, 3A–3C, or 6, rather than hot plates or pins penetrating through the tear-off region, the stack of bags can be unitized by a hot plate being applied to a top edge of the stack of bags. Either a flat blade or a cylindrical pin can be used to unitize a top region of the stack. Alternatively, the wicket hole itself can be the location of unitizing around its inner circumference. Furthermore, rather than a single flat hot plate unitizing a flat region of the stack of bags, a plurality of hot pins, arranged in parallel, can be applied to a top surface of the stack of bags in order to unitize the bag stack. Such arrangements for unitizing are described in detail in U.S. Ser. No. 09/517,968.

Although melt-fusing is an effective method of unitizing the bag stack, it is also possible to unitize the stack by the use of adhesive, such as applied on the exposed, stacked top edges of the bags in the stack.

Although the embodiments illustrate "lines" or "segments" of perforations as being straight or linear, such lines could also be curved lines or segments without departing from the invention.

From the foregoing, it will be observed that numerous variations and modifications may be effected without departing from the spirit and scope of the invention. It is to be understood that no limitation with respect to the specific articles or apparatus illustrated herein is intended or should be inferred. It is, of course, intended to cover by the appended claims all such modifications as fall within the scope of the claims.

The invention claimed is:

1. A block of bags comprising a plurality of bags stacked in overlying relationship, each bag having:

a top edge, a bag mouth and opposite first and second lateral edges;

a first edge cut on the first lateral edge of said bag, a first uncut region adjacent said first edge cut of said bag, and a first elongated cut extending laterally inwardly from said first uncut region;

a second edge cut on the second lateral edge from said bag, a second uncut region adjacent said second edge cut of said bag, and a second elongated cut extending laterally inwardly from said second uncut region, said first and second edge cuts spaced at a first distance from said hag mouth of said bag;

a central line of perforations extending substantially between inner ends of said first and second elongated cuts, said central line of perforations being discontinuous from said edge lines of perforations by being offset from a line extending between said first and second edge cuts, wherein said central line is spaced from said bag mouth by a second distance greater than said first distance, and a tear-off region is defined between said central line of perforations and said top edge; and at least one unitizing area extending through, and connecting, said stack of bags, said unitizing area located within said tear-off region.

2. The block of bags according to claim 1, said first and second elongated cuts comprising angled segments respectively extending to said central line of perforations.

3. The block of bags according to claim 1, including first and second substantially longitudinal lines of perforation extending from said central line of perforations upwardly to said top edge of said bag, extending substantially from opposite ends of said central line of perforations, wherein said substantially longitudinal lines of perforations create corner tear-off regions, said corner tear-off regions each including a unitizing area therein.

4. The block of bags according to claim 1, wherein said central line of perforations only extents between said first and second elongated cuts.

5. A block of bags, comprising:

a stack of bags, each bag having a top edge and first and second lateral edges, and a bag mouth;

two corner tear-off regions, respectively located adjacent opposite upper corners of said bag; and a central tear-off region located between said top edge, said bag mouth and said corner tear-off regions; and a unitizing area located within said central tear-off region, each said bag of said stack including first and second, generally aligned elongated cuts respectively extending inwardly from first and second uncut regions each adjacent a respective one of said first and second lateral edges, and a central line of perforations spaced from said bag mouth a distance greater than the spacing of said first and second elongated curs from said bag mouth, and extending between said elongated cuts.

6. The block of bags according to claim 5, comprising a unitizing area located within each tear-off region.

7. The block of bags according to claim 5, wherein each said corner tear-off region is defined by lines of perforation.

8. The block of bags according to claim 5, wherein each said corner tear-off region is substantially rectangular.

9. The block of bags according to claim 8, wherein said corner tear-off regions extend closer to the bag mouth than said central tear-off region.

10. The block of bags according to claim 5, wherein said central tear-off region comprises a unitizing area therein.

11. The block of bags according to claim 5, wherein said central tear-off region includes wicket holes.

12. A block of bags comprising a plurality of bags stacked in overlying relationship, each bag having:

a top edge, a bag mouth and opposite first and second lateral edges;

a first edge line of perforations extending from a first edge point on the first lateral edge of said bag;

a second edge line of perforations extending from a second edge point on the second lateral edge from said bag, said first and second edge points spaced at a first distance from said bag mouth of said bag;

a central line of perforations extending substantially between inner ends of said first and second edge lines of perforations, said central line of perforations being discontinuous from said edge lines of perforations, a tear-off region defined between said central line of perforations and said top edge; and at least one unitizing area extending through, and connecting, said stack of bags, said unitizing area located within said tear-off region, each said bag further comprising first and second substantially longitudinal lines of perforations extending from said central line of perforations upwardly to said top edge of said bag, extending substantially from opposite ends of said central line of perforations.

13. The block of bags according to claim 12, wherein said substantially longitudinal lines of perforations create corner tear-off regions, said corner tear-off regions each including a unitizing area therein.

* * * * *